US005828927A

United States Patent [19]

Yoo et al.

[11] Patent Number: 5,828,927

[45] Date of Patent: Oct. 27, 1998

[54] METHOD OF PREVENTING BACK SIDE OF PAPER FROM CONTAMINATION IN ELECTROPHOTOGRAPHY PRINTER

[75] Inventors: Yong-Baek Yoo; Moon-Sik Lee, both of Suwon-si, Rep. of Korea; Tagoku Izumi, Dongkyungdo, Japan

[73] Assignee: SamSung Electronics Co., Ltd., Suwon, Rep. of Korea

[21] Appl. No.: 874,131

[22] Filed: Jun. 12, 1997

[30] Foreign Application Priority Data

Jun. 12, 1996 [KR] Rep. of Korea ..... 1996/21023

[51] Int. Cl.[6] ..... G03G 15/16; G03G 21/00

[52] U.S. Cl. ..... 399/101; 399/66; 399/296

[58] Field of Search ..... 399/66, 98, 101, 399/128, 296, 314, 88, 388; 355/30

[56] References Cited

U.S. PATENT DOCUMENTS

| | | | |
|---|---|---|---|
| 4,459,691 | 7/1984 | Yamada | 369/126 |
| 5,019,764 | 5/1991 | Chang | 318/627 |
| 5,078,463 | 1/1992 | Kawawada | 359/201 |
| 5,124,744 | 6/1992 | Ogura et al. | 355/51 |
| 5,132,738 | 7/1992 | Nakamura et al. | 399/101 |
| 5,253,022 | 10/1993 | Takeuchi et al. | 399/66 X |
| 5,337,127 | 8/1994 | Imaue | 399/101 |
| 5,621,509 | 4/1997 | Karashima et al. | 399/66 X |
| 5,692,232 | 11/1997 | Okano et al. | 399/66 X |

FOREIGN PATENT DOCUMENTS 8-211760 8/1996 Japan .

*Primary Examiner*—Arthur T. Grimley
*Assistant Examiner*—Sophia S. Chen
*Attorney, Agent, or Firm*—Robert E. Bushnell, Esq.

[57] ABSTRACT

A back side of a paper is protected from contamination during an operation of the electrophotographic printer. A light scanning unit is warmed up as the main motor operates. This should minimize the potential difference on the surface of the photosensitive drum. A zero or a less than zero voltage is applied to its transfer roller to prevent the toner from adhering to the transfer roller before a paper reaches the transfer roller. This protects the back side of the paper from contamination due to the toner.

19 Claims, 9 Drawing Sheets

METHOD OF PREVENTING BACK SIDE OF PAPER FROM CONTAMINATION IN ELECTROPHOTOGRAPHY PRINTER

CLAIM OF PRIORITY

This application makes reference to, incorporates the same herein, and claims all benefits accruing under 35 U.S.C. § 119 from an application entitled *Method of Preventing Back Side of Paper From Contamination in Electrophotography Printer* earlier filed in the Korean Industrial Property Office on 12 Jun. 1996, and there duly assigned Ser. No. 96-21023 by that Office.

BACKGROUND OF THE INVENTION

1. Field of the Invention

The present invention relates to a method of controlling an electrophotographic printer. More particularly, the present invention relates to protecting the back side of a paper from contamination in an electrophotographic printer.

2. Discussion of Related Art

Today, many types of electrophotography printers (such as laser beam printers) exist. An electrophotography processor of such a printer creates visual images from an electrostatic latent image that attracts toner. The toner is subsequently fused to the paper according to the electric potential differences on a photosensitive drum. This electrophotographic process typically consists of: charging the photosensitive drum; exposing the surface of a charged photosensitive drum with light to create an electrostatic latent image; creating a visual image from the electrostatic latent image on the photosensitive drum using a developer; and transferring the image on the photosensitive drum to the paper. The process of exposing the surface of the charged photosensitive drum may involve a technique of using a light emitting diode (LED), and a technique of using laser scanning unit (LSU). The present invention is concerned with an electrophotography process that uses a light scanning unit.

One problem in such an electrophotography process is contamination of paper due to a residue charge. Even after a considerable time passes after the printer operates, some charge is left on the photosensitive drum of many electrophotography printers. When the warming-up of such a printer is finished, and normal operation state is confirmed, the main motor starts to rotate the photosensitive drum. A small amount of toner adheres to the exposed portion of the drum because of the edge effect even if its developing roller is not biased. When this toner reaches the transfer roller, it is transferred to the transfer roller by a voltage which is applied to clean the remaining toner on the drum. When the paper is conveyed between the photosensitive drum and transfer roller immediately following this, the toner adheres to the back of the paper, contaminating the paper. If there is time to rotate the photosensitive drum several times, it is possible to clean the toner adhering to the transfer roller. However, there is insufficient time to rotate the drum when a manual feeding is to be used. Thus, there is a need for an effective control of the printer having a light scanning unit, so as to prevent contamination of paper by having an effective control of electric potentials. On this matter, an exemplar of the contemporary practice is Yamada (U.S. Pat. No. 4,459,691, Arrangement For Preventing Discharge Current Flow Between A Rotary Recording Medium And A Reproducing Stylus In A Rotary Recording Medium Reproducing Apparatus, Jul. 10, 1984) discussing a setting the electrical potential of a rotary recording medium of the reproducing stylus, so that a discharge current which damages the electrode of the reproducing stylus substantially does not flow. Despite Yamada's effective handling of electrical potential differences, Yamada appears to be of limited applicability to printers. Chang (U.S. Pat. No. 5,019,764, Portable Laser Scanning System And Scanning Methods Having A Resonant Motor Control Circuit, May 28, 1991) discusses controlling both the frequency and amplitude of oscillation of a motor. The high speed scanning motor of the laser scanning system maintains a consistent scanning speed and use less power. Despite Chang's effective coordination of a motor and light scanning, Chang appears to be of limited applicability to printers. Kawawada (U.S. Pat. No. 5,078,463, Laser Beam Scanning Device, Jan. 7, 1992) discusses a controlling circuit that produces a common clock signal for controlling and driving the main motor and the pulse motor according to the common clock signal. When the photosensitive drum comes to a vicinity of a predetermined angular position, the laser is turned on. Ogura et al. (U.S. Pat. No. 5,124,744, Original Scanning Apparatus And Image Forming Apparatus, Jun. 23, 1992) discusses preventing the scanning motor from being out of step. The stator and rotor are prevented from being shifted in position with reference to each other, thereby making possible an image free from blur. From my study of the contemporary practice and art, I find that there is a need for an improved and effective control of the printer having a light scanning unit, so as to prevent contamination of paper.

SUMMARY OF THE INVENTION

An object of the present invention is to provide an improved method of protecting the paper from contamination in an electrophotography printer.

An object of the present invention is to provide a method of protecting the paper from contamination in an electrophotography printer, in which its scanning unit is warmed up as its main motor operates.

An object of the present invention is to provide a method of reducing the local optical wear of its photosensitive drum, and the timing of application of a voltage to its transfer roller, to thereby prevent the back surface of the paper from contamination.

An object of the present invention is to provide a method of protecting the paper from contamination in an electrophotography printer, in which its scanning unit is warmed up as its main motor operates, to reduce the local optical wear of its photosensitive drum, and the timing of application of a voltage to its transfer roller, to thereby prevent the back surface of the paper from contamination.

To accomplish the object of the present invention, there is provided a method and device for preventing the back surface of paper from being contaminated in an electrophotography printer using transfer roller. The method may include a step of driving a main motor while warming up a scanning unit, to minimize the potential difference created on the surface of a photosensitive drum. The method may also include a step of applying zero or negative voltage to the transfer roller, immediately before and after the area of the photosensitive drum, to which exposure is carried out and toner adheres, reaches the transfer roller, during time ($\Delta t+2\alpha$), where a predetermined time ($\alpha$) is added to the time ($\Delta t$) required for exposing the photosensitive drum, thus preventing toner on the photosensitive drum from being transferred to the transfer roller.

To achieve these and other objects, there is also provided an electrophotographic printer which protects the back side of a paper from contamination. The light scanning unit (LSU) may be warmed up as the main motor operates. This is to minimize the potential difference on the surface of the photosensitive drum. A zero (0) or a negative (–) voltage may be applied to its transfer roller to prevent the toner (which adheres to the photosensitive drum) from adhering to the transfer roller before a paper reaches the transfer roller, to thereby protect the back side of the paper from contamination due to the toner.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENT

Figure 1:
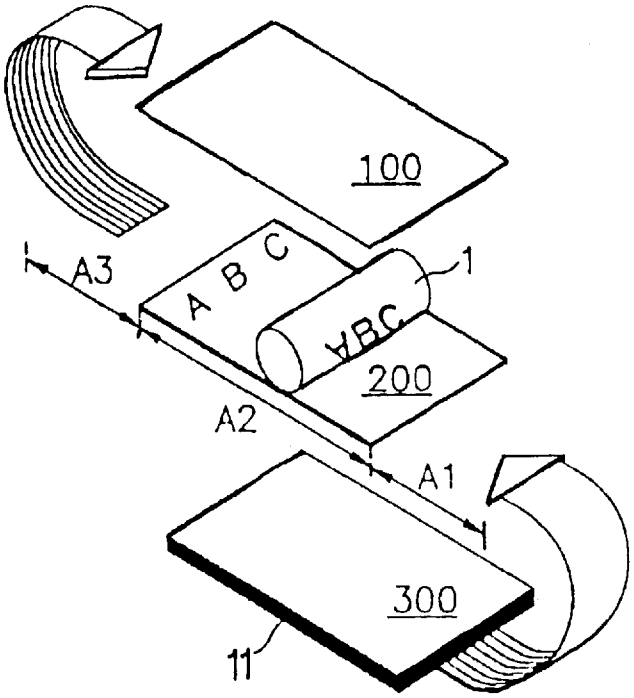
FIG. 1 is a diagram illustrating processes during an operating state of a contemporary image transfer process.

Turning now to the drawings, FIG. 1 shows the printing process of a contemporary laser beam printer. As shown in FIG. 1, the printing process includes: first step A1 of supplying paper 300, stored in a paper cassette 11, to a printer by a pick-up roller; second step A2 of transferring an electrostatic latent image, formed on a photosensitive drum 1, to the supplied paper 200 using charging, exposing, developing and transferring processes; and third step A3 of fusing the toner to the paper with heat and pressure using heating and compression rollers, and discharging the paper 100, where printing is completed, from the printer.

Figure 2:
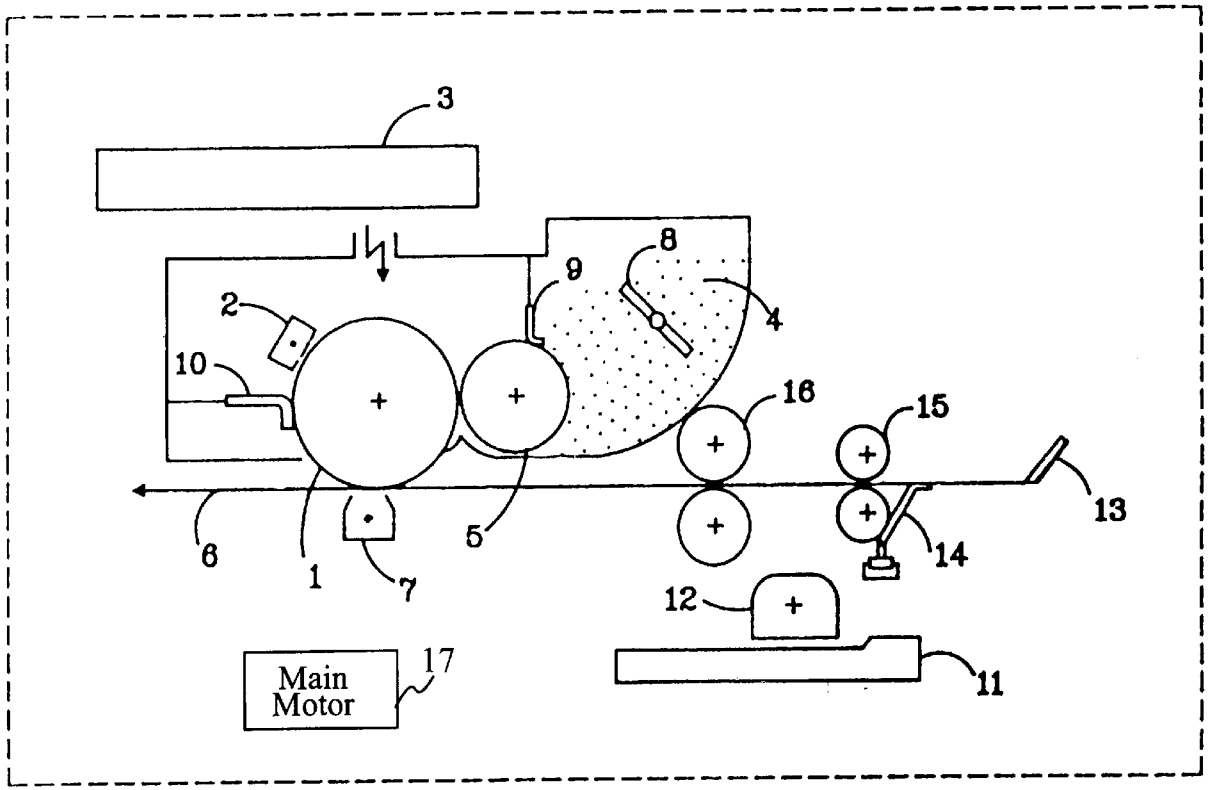
FIG. 2 is a view showing a configuration a laser printer with a paper arrangement function.

FIG. 2 illustrates, among others, an image transferring section of a contemporary electrophotographic processor. The image transferring section includes: a photosensitive drum 1, on which the image is formed; a charging device, for charging photosensitive drum 1; a scanning unit 3, for transferring an electrostatic latent image to the charged surface of photosensitive drum 1; a developing roller 5, for producing a toner image from the electrostatic latent image using a toner compound 4; an agitator 8, for uniformly mixing toner 4, which is kept in a toner hopper; a blade 9, for making the toner layer on developing roller 5 uniform; a cleaner 10, for removing the remaining toner on photosensitive drum 1; a paper cassette 11, for storing paper to be printed; a pick-up roller 12, for picking up the paper from the cassette, on receiving a predetermined signal, and conveying it; a feeding sensor 14, for sensing the paper which is supplied from pick-up roller 12 or a manual feeding tray 13; a feeding roller 15, for carrying the paper supplied from the pick-up roller 12; and a register roller 16, for arranging the leading edge of the paper transmitted from feeding roller 15. Charging device 2 and transfer device 7 do not come into contact with photosensitive drum 1. The process of image transferring in the electrophotographic processor is often as follows. Charging device 2 uniformly charges (corona charges) the surface of photosensitive drum 1 with high voltage. An electrostatic latent image is created on the charged surface of photosensitive drum 1, by scanning unit 3 which converts a digital signal from a computer into light. The electrostatic latent image meets a thin uniform toner layer 4 on developing roller 5, which is in close proximity to the surface of photosensitive drum 1, and thus produces a visual image. This image is transferred to paper 6 by high voltage of transfer device 7. The image on paper 6 passes between a heating roller and pressure roller of fixation device, thus being fused to paper 6 by heat and pressure. Then, it is discharged from the printer through an exit roller (not shown). When manual feeding where paper 6 is loaded through manual feeding tray 13, sensor 14 senses it, and the main motor 17 of the processor operates until the paper is caught by feeding roller 15, and then stops. When data is received from a computer to start printing, the paper is arranged at register roller 16, waits until the photosensitive drum can print the image, and register roller 16 operates using an interrupter (not shown). Thus, the paper is printed. When the paper is carried from cassette 11 to photosensitive drum 1 using pick-up roller 12, photosensitive drum 1 rotates at least twice, to reach the state where it can print, and register roller 16 does nothing but arranging the paper. However, when manual feeding, the photosensitive drum does not have enough time to reach the state where it can print because the traveling distance of the paper is short. Thus, to give the minimum time for photosensitive drum 1 to reach this state, register roller 16 is connected to the interrupter. This conveys the paper with a time delay.

Figure 3:
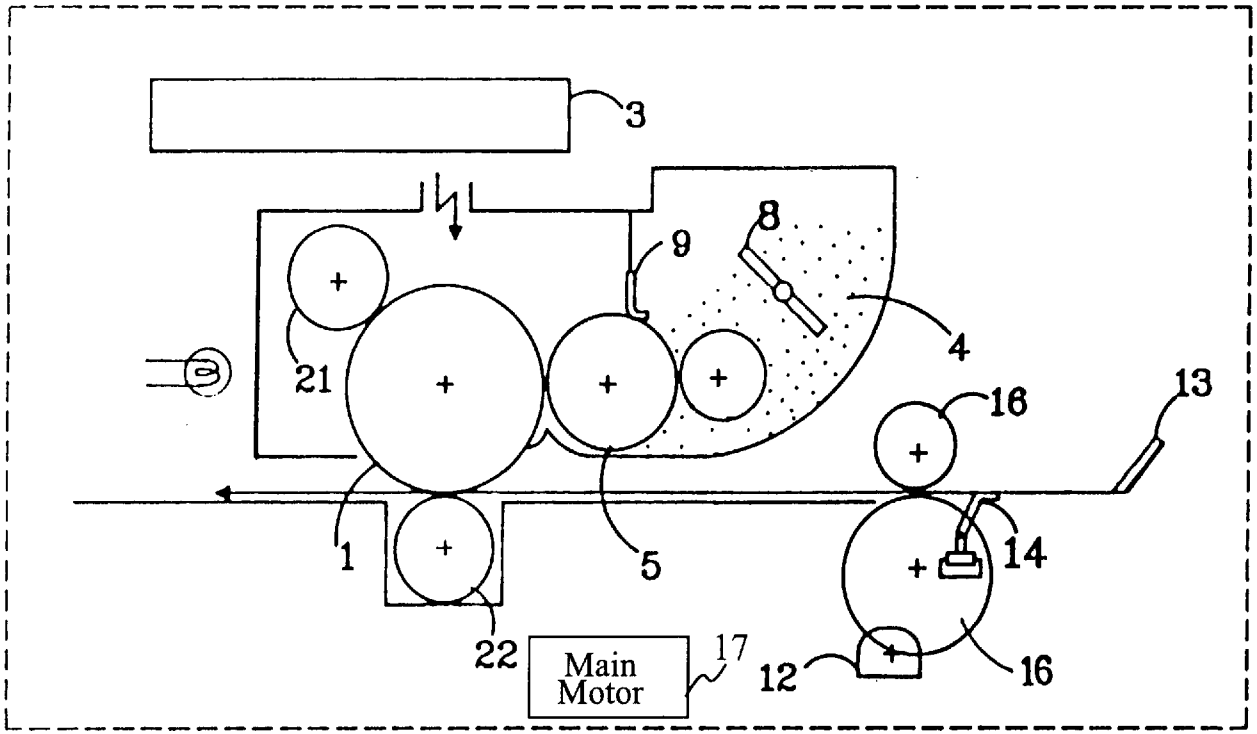
FIG. 3 is a view showing a configuration of a laser printer without a paper arrangement function.

FIG. 3 shows another image transferring apparatus using a different charging, transferring, and paper feeding mechanism from the above-described apparatus. This apparatus has no cleaner and register sensor, the charging and transferring processes are performed in when photosensitive drum 1 comes into contact with a conductive charging roller 21 and transfer roller 22. In this system, having no register sensor, there is no way to interrupt paper to allow the time required for the photosensitive drum to reach a printable state. As shown in FIG. 3, when printing starts, the paper on feeding roller 16 is conveyed by pick-up roller 12. Feeding sensor 14 detects the location of the paper, so that the parameters of photosensitive drum 1 operates at a predetermined timing. The apparatus starts to operate when the sensor senses the leading edge of the paper, in contrast to the system of FIG. 2, which starts to operate when the interrupter of the register roller starts to operate. With this apparatus, when the paper is conveyed from cassette 1 1, the photosensitive drum can rotate to reach the printable state before the paper reaches it. Accordingly, the paper is normally printed and is not interrupted. However, when manual feeding, feeding sensor 14 senses that the paper is put in the manual tray, the main motor 17 operates until the paper is caught in feeding roller 16, and then stops. When printing is started after receiving data from a computer, the main motor 17 starts to rotate, simultaneously, the paper is conveyed so as to touch feeding sensor 14 again. Then, the parameters of the photosensitive drum contributes to performing printing. Since main motor operation and paper conveying occur simultaneously, there is no minimum time for the photosensitive drum to reach the printable state. The toner adheres to the photosensitive drum during the LSU warming-up, thus contaminating the paper.

Figure 4:
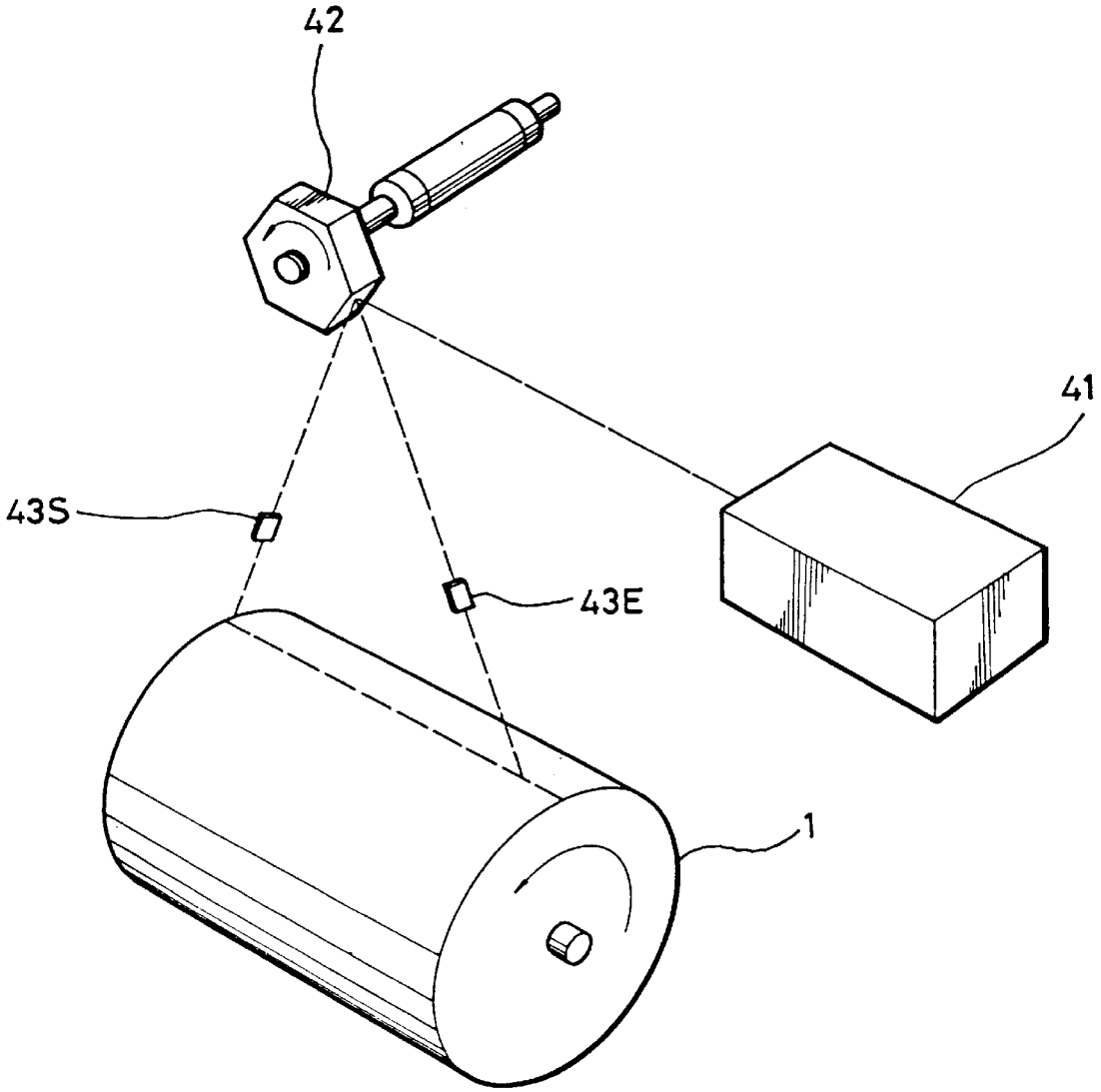
FIG. 4 illustrates a light scanning unit.

FIG. 4 roughly shows the general configuration of the LSU. The LSU includes: a laser emitting source 41, such as gas laser or semiconductor laser; a rotating polygon mirror 42 rotating at approximately 2000 to 5000 RPM, which deflects the light emitted from laser 41; beam detectors 43S and 43E, detecting the light deflected by polygon mirror 42; and a photosensitive drum 1 in which the surface potential when exposed to the light transmitted from the polygon mirror differs from areas not exposed to light. The laser beam emitted from laser emitting source 41 exposes the surface of photosensitive drum 1 as polygon mirror 42 rotates, to differentiate the surface potential of areas of the drum corresponding to desired images. Beam detectors 43S and 43E are located at the start and end points of beam which scans photosensitive drum 1 using polygon mirror 42, and detects the start and end of the beam. During the warming-up of the LSU, polygon mirror 42 starts to rotate, to send a light to beam detectors 43S and 43E, until the mirror rotates at the normal speed where printing is normally operated.

By doing so, the photosensitive drum is exposed. This exposure is carried out for 60 msec, the minimum time for the LSU to finish the warming-up. This warming-up time is required to confirm the normal speed of the polygon mirror, which is recognized using the warming-up of the laser emitting source, and beam detectors. Meanwhile, it takes 0.9 msec to expose one line on the photosensitive drum during printing. Thus, printing needs exposure level in excess of sixty times than that required for warming up. Accordingly, even though considerable time passes after the printer operates, some charge is left on the photosensitive drum. When the warming-up is finished, and normal operation state is confirmed, the main motor 17 starts to rotate the photosensitive drum, and a small amount of toner adhere to the exposed portion of the drum because of the edge effect even if developing roller 5 is not biased. When this toner reaches the transfer roller, it is transferred to the transfer roller by a voltage which is applied to remove the remaining toner on the drum. When the paper is conveyed between the photosensitive drum and transfer roller immediately following this, the toner adheres to the back of the paper, contaminating the paper. If there is time to rotate the photosensitive drum several times, it is possible to clean the toner adhering to the transfer roller. There is insufficient time to rotate the drum, however, when a manual feeding is to be used.

Figure 5:
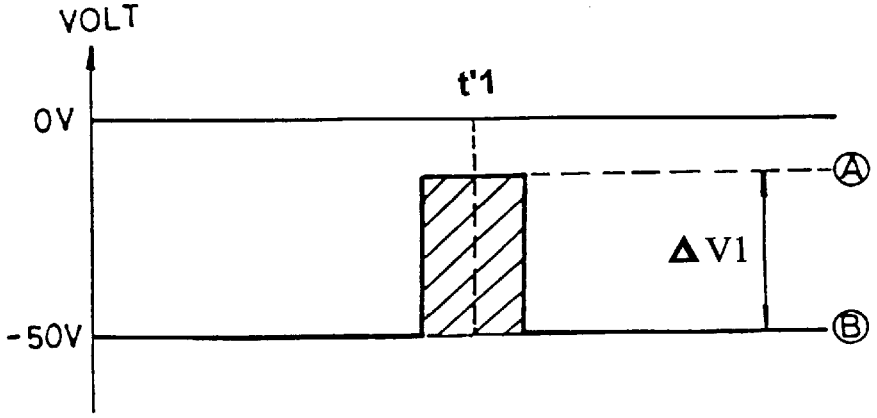
FIG. 5 is a timing diagram showing the potential differences on the photosensitive drum of a contemporary laser printer.
Figure 6:
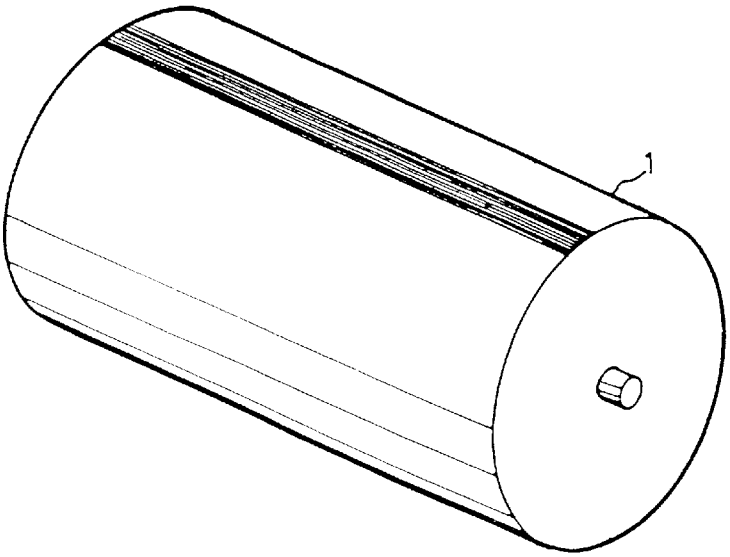
FIG. 6 shows the surface situation of the photosensitive drum of FIG. 5, the situation having been created by the potential difference of FIG. 5.
Figure 7:
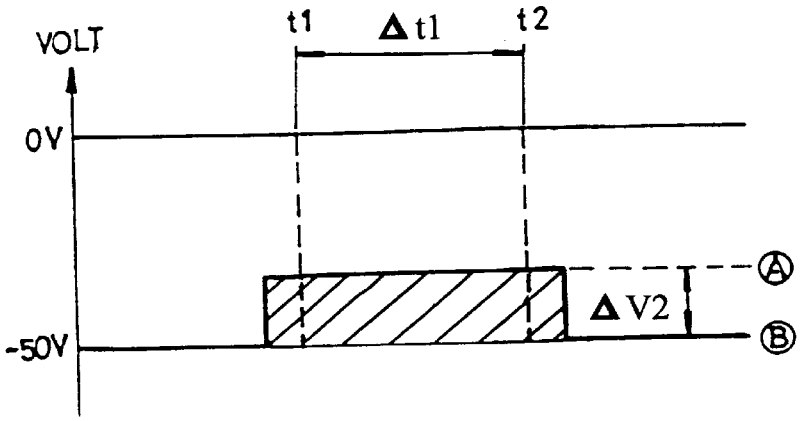
FIG. 7 is a timing diagram showing the potential difference created on the surface of the photosensitive drum of a laser printer according to the present invention.

FIG. 5 shows the potential difference created on the surface of the photosensitive drum of a contemporary laser printer. Laser light, which is reflected by the polygon mirror, concentrically scans a specific portion of the photosensitive drum, which is charged to −800V as soon as the LSU warms up. By doing so, the photosensitive drum is given a potential of −15V (at a time rotated in emphasis and including the time t'1) for time Δt1, that is, the time (in the notation of FIG. 7, this is from t1 to t2) from the time when the polygon mirror starts to rotate to the time when normal speed is attained, and potential difference ΔV1 is created on the surface of the photosensitive drum. Because of this potential difference, a scanning line is created on the surface of the photosensitive drum, as shown in FIG. 6. Therefore, the photosensitive drum is worn much more, and contamination occurs on the back side of the paper. In FIGS. 5 and 7, t1 indicates the time when the photosensitive drum starts to be exposed as the LSU warms up, t2 indicates the time when the exposure of the photosensitive drum is completed during the warming-up of the LSU and when the main motor operates, Δt1 indicates the warming-up time (t2−T1) of the LSU, (A) indicates the potential on the photosensitive drum as it is exposed during the LSU warming-up, and (B) indicates the remaining potential on the photosensitive drum.

Figure 8:
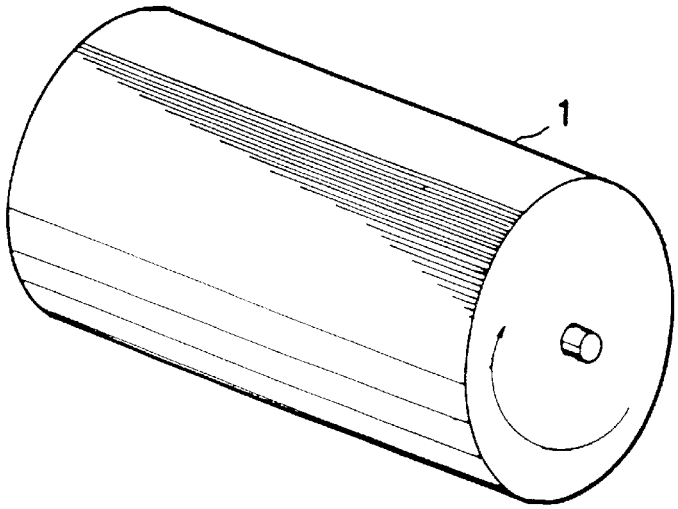
FIG. 8 shows the surface situation of the photosensitive drum of FIG. 7, the situation having been created by the potential difference of FIG. 5.

A preferred embodiment of the present invention is as follows. In contrast to the situation described in the previous paragraphs, when the LSU warms up as the main motor operates, the photosensitive drum also rotates during the period from t1 to t2 as shown in FIG. 7, so as to reduce the potential difference on the photosensitive drum by ΔV2. Furthermore, the photosensitive drum is partially scanned because the laser light scans the surface of the rotating photosensitive drum, so that optical wear of the photosensitive drum is decreased. The scanning pattern on the photosensitive drum is shown in FIG. 8. In contrast to a contemporary operation, the scanning line is not repeatedly applied to the same small area, but over a wider area as the photosensitive drum rotates, as shown in FIG. 6. Thus, the potential difference on the exposed area of the photosensitive drum is decreased.

This reduces optical wear on the exposed portion, and the amount of toner adhering to it, thus greatly decreasing the contamination on the back side of the paper. Thus, a small area on the photosensitive drum is not excessively worn out. The small area on the surface of the photosensitive drum is not constantly exposed thus reducing wear on the photosensitive drum, the amount of toner transferred to the photosensitive drum, and contamination on the transfer roller, which resulted from the toner adhering to the photosensitive drum. When manual feeding is performed, the back side of the paper is free from contamination. Even though a small amount of toner adheres to the photosensitive drum, it is transferred to the transfer roller when (+)voltage is applied to the transfer roller. This also may contaminates the back side of the paper. To solve this problem, zero (0) or (−) voltage is applied to the transfer roller. This prevents the toner from being transferred to the transfer roller.

Figure 9:
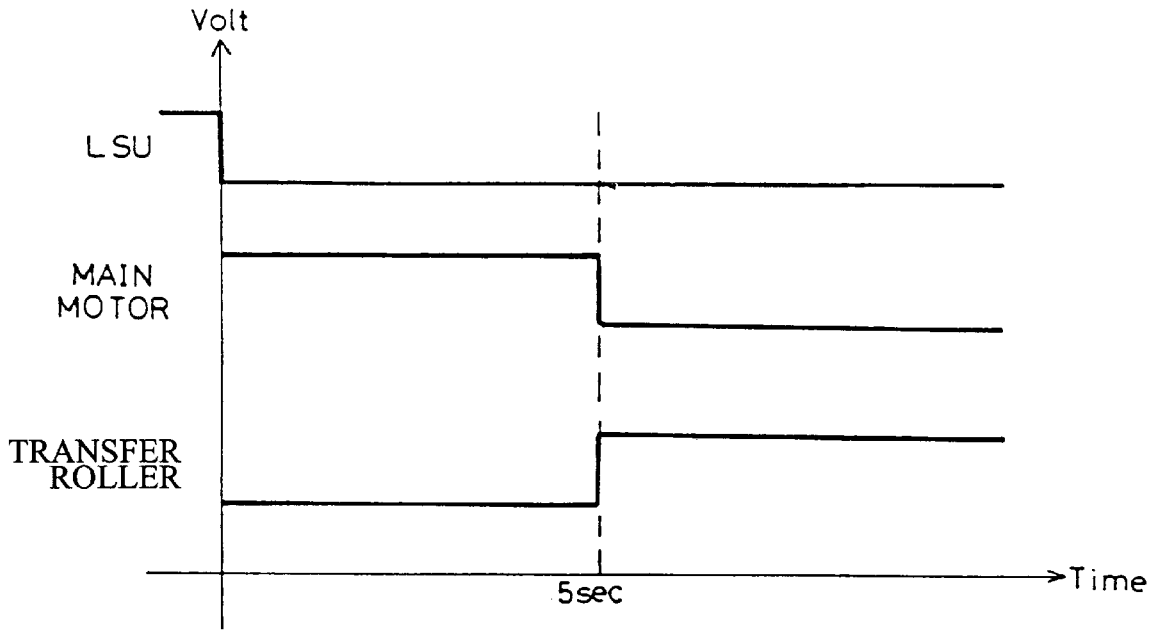
FIG. 9 is a timing diagram of a contemporary laser printer.

FIG. 9 is an operation timing diagram of the components of a contemporary laser printer. As shown in FIG. 9, the main motor starts to operate after the warm-up (approximately for five seconds) of the LSU is complete. A charge is applied to the transfer roller after the warm-up is completed.

Figure 10:
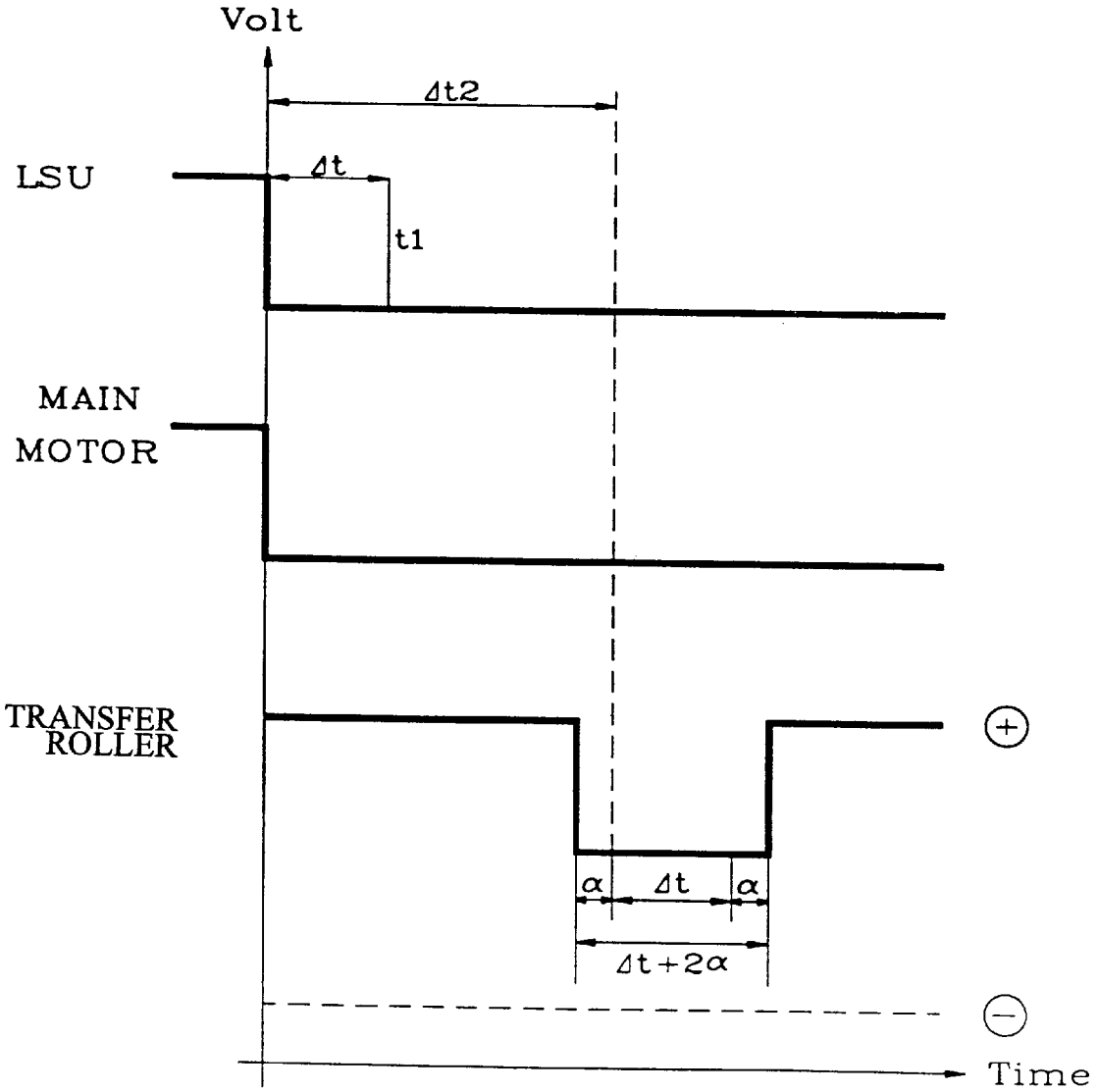
FIG. 10 is a timing diagram of a laser printer according to the present invention.

FIG. 10 gives a contrast to FIG. 9. FIG. 10 is a timing diagram of the components forming the printer according to the present invention. As shown in FIG. 10, while the LSU warms up the main motor operates to expose a large area on the surface of the photosensitive drum, not a local area. 0 or (−) voltage is applied to the transfer roller when the exposed portion reaches the transfer roller. That is, the voltage is applied to the transfer roller with a lapse of time Δt2 during which the photosensitive drum is charged, developed, and then reaches the transfer roller.

Figure 11:
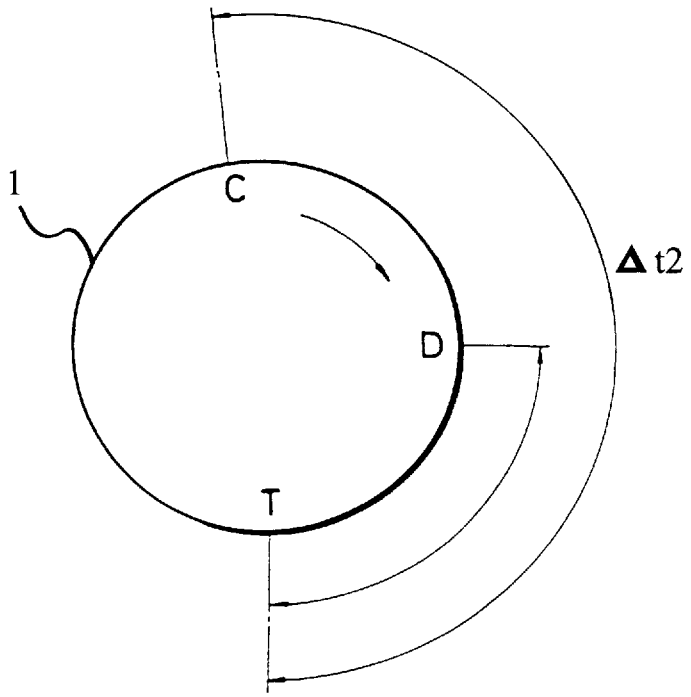
FIG. 11 shows the operating state of the photosensitive drum during a period of time.

FIG. 11 is a timing diagram showing the operating state of this photosensitive drum as a function of time. This shows time Δt2 required for charging (c), developing (d) and transferring (t) processes. As shown in FIG. 10, the main motor and LSU operate simultaneously. A zero (0) or (−) voltage is applied to the transfer roller over time Δt+2α (where Δt indicates the time during which the photosensitive drum is exposed), with the lapse of time Δt2, which is required for the exposed area of the photosensitive drum to reach the transfer roller, to thereby prevent a small amount of toner from adhering to the exposed portion of the photosensitive drum, contaminating the transfer roller. The method of preventing the back surface of the paper from being contaminated using the present invention requires two steps. At the first step, the main motor operates during the warming-up of the LSU, to expose a broad area of the surface of the photosensitive drum, thus minimizing the amount of the toner which adheres to the photosensitive drum. At the second step, a zero (0) or (−) voltage is applied to the transfer roller over time $\Delta t+2\alpha$ immediately before and after the exposed portion of the photosensitive drum (which, as stated in the previous sentence, adheres to the photosensitive drum) reaches the transfer roller.

By doing so, toner from the photosensitive drum is not transferred to the transfer roller. When the LSU is used as an optical system in an electrophotographic printer which has no separate paper interrupting device for controlling the paper, the back side of the paper can be prevented from being contaminated. This can be applied to manual feeds. Also, when the photosensitive drum stops, the wear on the photosensitive drum (much of which can occur during the warming-up of the LSU) can be minimized.

Therefore, it should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A method of printing using an electrophotographic printer, the method comprising the steps of:

minimizing a potential difference created on a surface of a photosensitive drum of the electrophotographic printer by driving a main motor of the electrophotographic printer while warming up a scanning unit of the electrophotographic printer; and preventing the toner from adhering to the photosensitive drum during a period of exposing the photosensitive drum for receiving an image on the photosensitive drum, and preventing the toner from adhering to a transfer roller of the electrophotographic printer before a paper reaches the transfer roller, the transfer roller for transferring toner to the paper, by applying a non-positive voltage to the transfer roller from a first predetermined time before said period of exposing the photosensitive drum to a second predetermined time after said period of exposing the photosensitive drum.

2. The method of claim 1, wherein the electrophotographic printer controls paper feeding without involving a register sensor.

3. The method of claim 1, wherein optical wear of the photosensitive drum is reduced by preventing a repeated exposure to a single, small area of the photosensitive drum.

4. The method of claim 3, wherein the electrophotographic printer controls paper feeding without involving a register sensor.

5. The method of claim 1, wherein the paper is fed manually into the electrophotographic printer.

6. The method of claim 5, wherein the electrophotographic printer controls paper feeding without involving a register sensor.

7. The method of claim 6, wherein optical wear of the photosensitive drum is reduced by preventing a repeated exposure to a single, small area of the photosensitive drum.

8. The method of claim 5, wherein optical wear of the photosensitive drum is reduced by preventing a repeated exposure to a single, small area of the photosensitive drum.

9. The method of claim 1, wherein the preventing step discourages the toner from contaminating a surface of the paper.

10. An electrophotographic printer, comprising:

means for minimizing a potential difference created on a surface of a photosensitive drum of the electrophotographic printer by driving a main motor of the electrophotographic printer while warming up a scanning unit of the electrophotographic printer; and means for preventing the toner from adhering to the photosensitive drum during a period of exposing the photosensitive drum for receiving an image on the photosensitive drum, and for preventing the toner from adhering to a transfer roller of the electrophotographic printer before a paper reaches the transfer roller, the transfer roller for transferring toner to the paper, by applying a non-positive voltage to the transfer roller from a first predetermined time before said period of exposing the photosensitive drum to a second predetermined time after said period of exposing the photosensitive drum.

11. The electrophotographic printer of claim 10, wherein the electrophotographic printer controls paper feeding without involving a register roller.

12. The electrophotographic printer of claim 10, wherein optical wear of the photosensitive drum is reduced by preventing a repeated exposure to a single, small area of the photosensitive drum.

13. The electrophotographic printer of claim 12, wherein the electrophotographic printer controls paper feeding without involving a register roller.

14. The electrophotographic printer of claim 10, wherein the paper is fed manually into the electrophotographic printer.

15. The electrophotographic printer of claim 14, wherein the electrophotographic printer controls paper feeding without involving a register roller.

16. The electrophotographic printer of claim 14, wherein optical wear of the photosensitive drum is reduced by preventing a repeated exposure to a single, small area of the photosensitive drum.

17. The electrophotographic printer of claim 10, wherein the means for preventing discourages the toner from contaminating a back surface of the paper.

18. An electrophotographic printer, comprising:

a scanning unit;

a main motor, the main motor being driven while the scanning unit is being warmed up;

a photosensitive drum, said photosensitive drum being exposed for a period of time to receive an image from the scanning unit;

a transfer roller for transferring the image to a paper by transferring toner to the paper; and means for preventing the toner from adhering to the photosensitive drum during said period of time the photosensitive drum is being exposed, and for preventing the toner from adhering to the transfer roller before the paper reaches the transfer roller, by applying a non-positive voltage to the transfer roller from a first predetermined time before said period of time to receive the image to a second predetermined time after said period of time to receive the image.

19. The electrophotographic printer of claim 18, wherein the means for preventing discourages the toner from contaminating a back surface of the paper.

* * * * *